United States Patent [19]

Jarrett

[11] Patent Number: 4,944,480

[45] **Date of Patent: * Jul. 31, 1990**

[54] WALL MOUNTED CLOTHES HANGER

[75] Inventor: William E. Jarrett, 1465 Calvin, S.E., Grand Rapids, Mich. 49507

[73] Assignees: William E. Jarrett, Grand Rapids; Dan H. Vollink, Lowell, both of Mich.

[ * ] Notice: The portion of the term of this patent subsequent to Mar. 11, 2000 has been disclaimed.

[21] Appl. No.: 521,439

[22] Filed: Aug. 8, 1983

[51] Int. Cl.[5] ..... A47F 5/00

[52] U.S. Cl. ..... 248/309.1; 248/304; D6/327; D6/412

[58] Field of Search ..... 248/309.1, 309.2, 304; 223/85, 92; 211/30, 32; D6/315, 316, 320, 323, 327, 412; 16/121

[56] References Cited

U.S. PATENT DOCUMENTS

| | | | |
|---|---|---|---|
| 224,003 | 2/1880 | Drew | 248/304 |
| 239,465 | 3/1881 | Delany | 248/304 |
| D. 266,216 | 9/1982 | Markin | D6/316 |
| D. 282,885 | 3/1986 | Jarrett | D6/323 |
| 1,335,881 | 4/1920 | Dottl | 248/304 |
| 2,275,007 | 3/1942 | Caestecker | 248/309.1 |
| 4,372,450 | 2/1983 | Licari et al. | 211/32 |

FOREIGN PATENT DOCUMENTS

| | | | |
|---|---|---|---|
| 0889042 | 12/1943 | France | 248/304 |

*Primary Examiner*—Ramon O. Ramirez

*Attorney, Agent, or Firm*—Price, Heneveld, Cooper, DeWitt & Litton

[57] ABSTRACT

A wall mounted clothes hanger which includes a body having an upper convex surface. Each point on the surface along any vertical section through the center of volume enclosed by the surface has a radius of curvature of at least one inch but no more than two inches. The sides of the convex surface extend downwardly beyond their horizontal radii of curvature. The hanger includes a mount with a hole therein for securing the hanger to a wall.

1 Claim, 2 Drawing Sheets

WALL MOUNTED CLOTHES HANGER

BACKGROUND OF THE INVENTION

Over the years a variety of wall mounted clothes hangers have been introduced in the marketplace. Typically, these hangers have one or more upwardly projecting hooks on which articles of clothing are hung. Such hook have long been deemed to be undesirable because they can damage clothing. U.S. Pat. No. 224,003 issued to Drew, for instance, discloses a curved cross piece at the end of the hook to eliminate "a raised place on the garment" caused by such hangers. However, even designs such as that disclosed in the '003 patent does not eliminate another problem caused by such hooks. Generally, such hooks can leave wrinkles near the point on the clothing fabric attached to the hanger.

Furthermore, even curved hooks such as that disclosed in the '003 patent can often present an obstacle for young children or handicapped individuals to the removal of clothing from such hooks easily or without damage to the clothing. For instance, a young child unable to lift the clothing above a curved hook may attempt to impart a whipping motion to the clothing in an attempt to remove clothing from such a hook. However, when such whipping motion is imparted to clothing, the fabric may catch on the hook and damage the fabric.

SUMMARY OF THE INVENTION

It is an object of this invention to provide a wall mounted clothes hanger on which clothes can be securely hung without substantially wrinkling or damaging the fabric around the area of fabric hung on the hanger, and which can easily be used by anyone, even young children and handicapped individuals. The clothes hanger of the present invention broadly comprises a body having an upper convex surface wherein each point of said surface along any vertical section through the center of volume enclosed by the concave surface has a radius of curvature of at least about one but no more than two inches. Furthermore, the sides of the concave surface extend downwardly beyond their horizontal radii of curvature. Means are provided for securing the body to a wall.

DESCRIPTION OF THE PREFERRED EMBODIMENT

Figure 1:
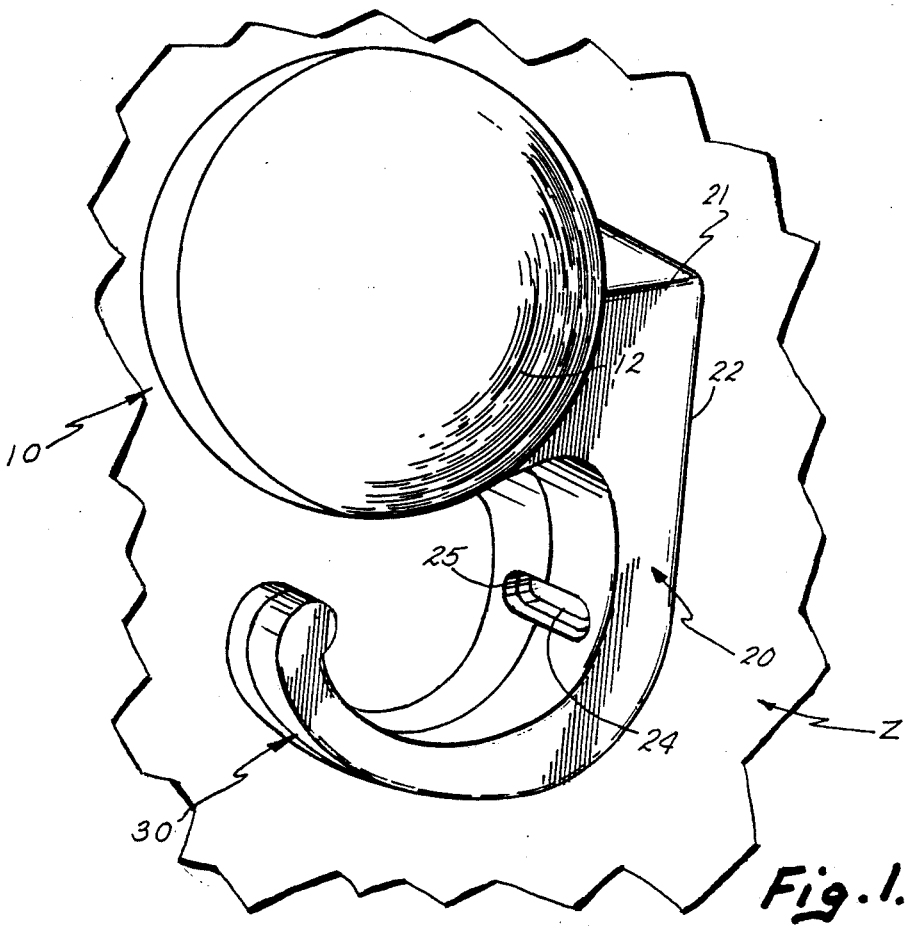
FIG. 1 is a perspective view of a preferred embodiment of the present invention.

In the preferred embodiment, the clothes hanger 1 of the present invention comprises a generally spherical body 10 joined to a mount 20 which facilitates mounting the invention on a wall 2 (FIG. 1). Depending downwardly from mount 20 is a secondary hook 30.

Body 10 is preferably a sphercial member. It has been found that for substantial wrinkling to be eliminated and to facilitate the removal of clothing by young children and handicapped individuals, body 10 should have a radius of at least about one inch but no more than about two inches. This upper limit is placed on the radial dimensions so that the clothing may be securely held on the sphere. Furthermore, larger spheres begin to appear unattractive when they are hung on a wall in a manner like that shown in FIG. 1.

Figure 4:
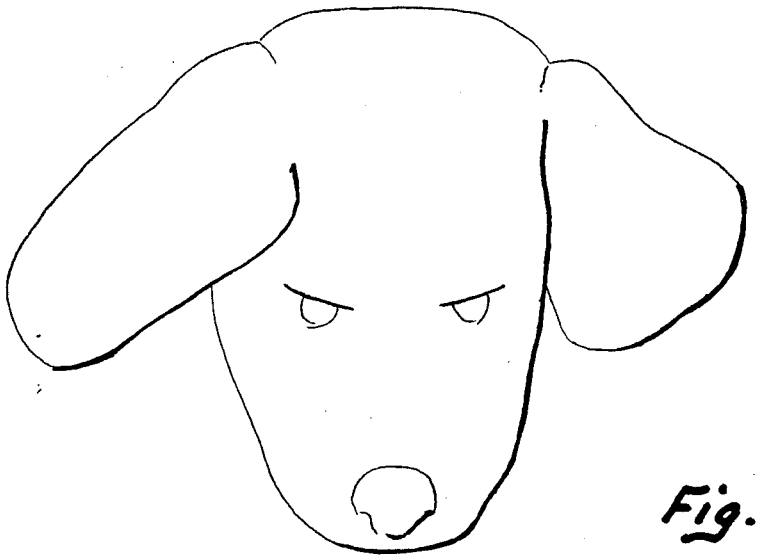
FIG. 4 is a perspective view of an animal head hanger.

It is not necessary that the present invention take the form of a sphere, however. Any generally convex surface can be employed provided that each point on the surface along any vertical section through the center of volume enclosed by the surface has a radius of curvature of at least about one inch but no more than two inches and provided that the sides of the surface indicated at 12 in FIG. 1 extend downwardly beyond their horizontal radii of curvature. For instance, an egg-shaped surface may be used. A suitably dimensioned model of an animal head, the dog head of FIG. 4, for instance, may also be used. The surface is generally smooth. The term generally smooth is meant to include the possibility that the surface may be textured or roughened slightly so as to provide better frictional surface on which to hang clothing. A few small dimples projecting just slightly from the upper surface of body 10 would also provide an acceptable friction surface and still leave the surface generally smooth. A conventional tacky adhesive type substance can also be applied to the surface for additional friction characteristics and grip.

Furthermore, it is not necessary to use an entire sphere as a wall-mounted clothes hanger. It has been found, however, that more than a semi-sphere must be mounted on the wall with the removed portion of the sphere being taken from the lower most portion of the sphere as shown in FIG. 1. When more than a semi-sphere is used, the sides of the sphere will extend beyond the horizontal radius of the sphere. For example, a sphere with a diameter of three inches must have sides which extend more than 1.5 inches below point 11, that is, the sides of the sphere will be lower than the horizontal radius of the sphere.

Mount 20 comprises a shoulder 21, a back wall 22, a screw slot 24 and a screw head recess 25. Screw head recess 25 is provided so that the screw (or screws) which are used to mount the hanger will not protrude. Screw slot 24 and screw head recess are expanded horizontally so as to accommodate two screws. Other advantages from recessing the screw slot 24 and expanding slot 24 and recess 25 will be discussed below.

A back wall recess 23 is provided on back wall 22 for securing an adhesive pad (not shown) which can be used to mount the hanger to a wall. The recess extends below screw slot 24 so a large pad can be used if desired. The pad can easily be perforated by screws inserted through the screw slot if it is later desired to secure the hanger to the wall with screws.

The wall mounted clothes hanger of the present invention also has a hook 30. To ensure that yound children and the physically handicapped can utilize the full benefits of the wall mounted clothes hanger produced according to the present invention, hook 30 should extend no further than the furthest point on the convex surface from wall 2. This feature substantially ensures that clothing will not become snagged on secondary hook 30 as the clothing is removed from the concaved surface by such individuals. Also, there will be less possibility of a user bumping hook 30 and being hurt.

Hook 30 should typically be designed such that its end will terminate an appropriate distance away from the bottom of body 10 in order that several articles of clothing can be hung on hook 30 between the end thereof and the bottom of the sphere if desired.

Figure 2:
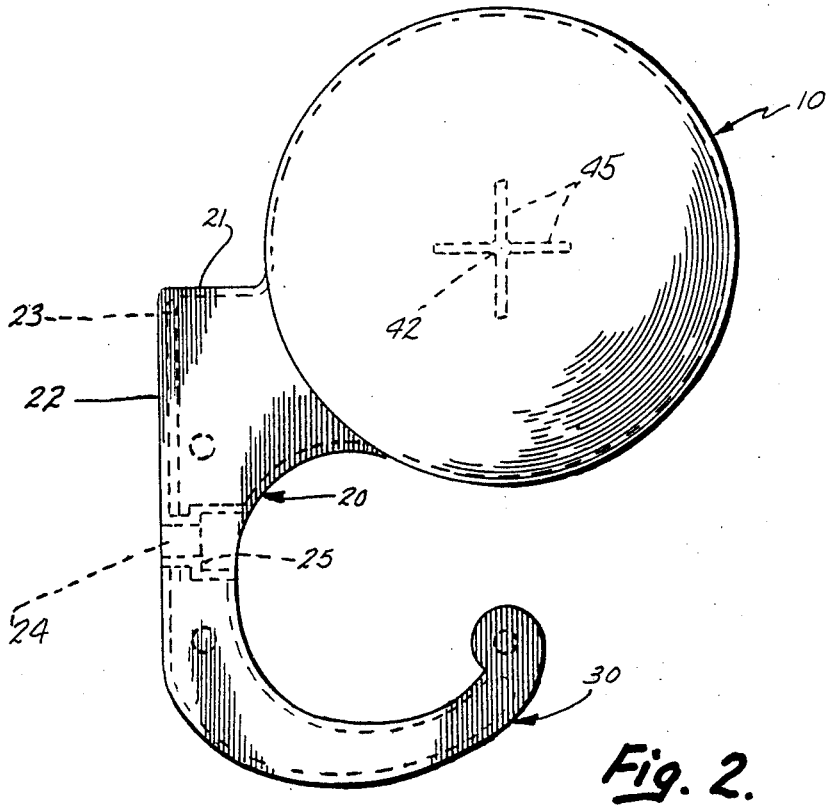
FIG. 2 is a side elevation of the hanger of the present invention illustrating various features in hidden lines.
Figure 3:
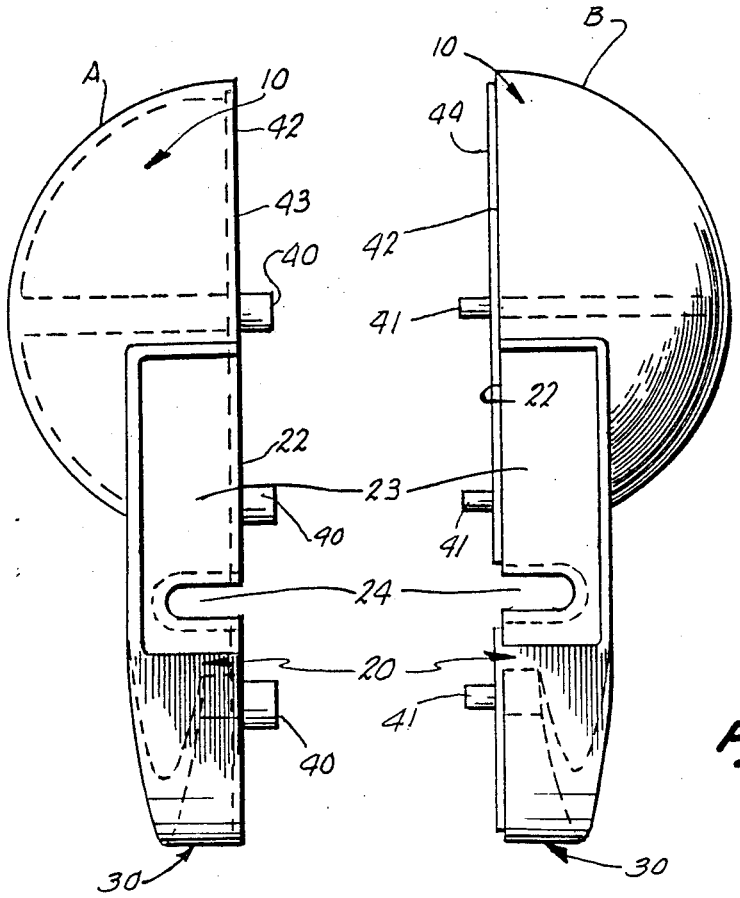
FIG. 3 is an exploded near view of the hanger of the present invention illustrating various features in hidden lines.

The clothes hanger is preferably injection molded in two halves A and B as shown in FIG. 3. The two halves can then be held together by means of bosses 40 and studs 41. So that the mating edges 42, 42' are not unsightly, a groove 43 along the mating edge 42 of half A receives a tongue 44 along mating edge 42' of half B. To reduce "sinking" or the unsightly contraction of injection molded plastic around areas of the molded product where much plastic is required, for instance, near screw slot 24, the screw slot is recessed as shown in FIGS. 1 and 2. Screw head recess 25 and screw slot 24 are expanded horizontally so as to eliminate the need for a cam to be used in the molding operation, or alternatively eliminate a large concentration of plastic behind screw slot 24 which would create a sink mark. Gussets 45 may also be added to support the center stud 42.

It should be apparent that if a yound child or handicapped person imparts a whipping motion to the bottom of an article of clothing hung on body 10, the clothing will snap off the body withoug catching on rough edges and without damaging the clothing. In addition, the clothing can easily be tossed on to the sphere eliminating the need for the rod-mounted clothes hanger, which, for handicapped invividuals at least can present a difficult obstacle to hanging clothes. Finally, few wrinkles will be left on the clothing hung on such a surface.

Having described the invention, it should be understood that although one preferred embodiment has been illustrated, other embodiments are possible within the broadest aspect of this invention and therefore the invention should not be limited except as provided by the following claims.

I claim:

1. A clothes hanger for mounting on a wall, comprising:

a body comprising an upper, curved, convex surface wherein each point on said surface along any vertical section through the center of volume enclosed by said surface has a radius of curvatures of at least about one inch but no more than two inches, and wherein the sides extend downwardly to beyond their horizontal radii; and a secondary clothes hook initially extending generally downwardly from said body and then extending upwardly to form a hook, wherein the end of said hook remains under said body and terminates at a point less distant from the wall than the outermost point of said body when said hanger is mounted on a wall, and the distance between said end and the lowermost portion of said body is such that a human head cannot come in direct contact with said end, said body shielding said end from such contact.

* * * * *